US009631854B2

(12) United States Patent
Seo et al.

(10) Patent No.: US 9,631,854 B2
(45) Date of Patent: Apr. 25, 2017

(54) ICE MAKER FOR REFRIGERATOR

(71) Applicant: LG ELECTRONICS INC., Seoul (KR)

(72) Inventors: Woonkyu Seo, Seoul (KR); Seungjin Yoon, Seoul (KR); Myunghwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 344 days.

(21) Appl. No.: 13/740,437

(22) Filed: Jan. 14, 2013

(65) Prior Publication Data

US 2013/0305766 A1 Nov. 21, 2013

(30) Foreign Application Priority Data

May 17, 2012 (KR) ..... 10-2012-0052368

(51) Int. Cl.
*F25C 1/24* (2006.01)
*F25C 1/22* (2006.01)
*F25C 1/10* (2006.01)

(52) U.S. Cl.
CPC ..... *F25C 1/24* (2013.01); *F25C 1/225* (2013.01); *F25C 1/10* (2013.01); *F25C 2400/14* (2013.01); *F25C 2500/06* (2013.01); *F25D 2323/122* (2013.01)

(58) Field of Classification Search
CPC ..... F25C 1/04; F25C 1/10; F25C 1/22; F25C 1/225; F25C 1/24; F25C 5/005; F25C 5/007; F25C 1/243; F25C 2400/14
USPC ..... 62/340, 345, 347
See application file for complete search history.

(56) References Cited

U.S. PATENT DOCUMENTS 3,000,187 A * 9/1961 Mussey ..... A01J 9/04 138/38
3,226,944 A * 1/1966 Connors ..... F25C 1/04 62/137
3,908,391 A * 9/1975 Wulke ..... F25C 1/04 62/137
6,351,966 B1 * 3/2002 Hochberg ..... B67D 3/0029 62/340

(Continued)

FOREIGN PATENT DOCUMENTS

CN 1160174 A 9/1997
CN 102410681 A 4/2012

(Continued)

OTHER PUBLICATIONS

European Search Report issued in Application No. 13167895.5 dated Sep. 7, 2015.

(Continued)

*Primary Examiner* — Mohammad M Ali
(74) *Attorney, Agent, or Firm* — KED & Associates, LLP

(57) ABSTRACT

An ice maker for a refrigerator is provided that may accurately and simply supply a predetermined amount of water to an ice tray. The ice maker may include an ice tray for receiving water for freezing into ice, a water container including a body for storing and supplying a predetermined amount of water to the ice tray and a lid coupled to the body and having holes for discharging water from the water container, and a housing for installing the water container in a case of the ice maker.

20 Claims, 10 Drawing Sheets

(56) References Cited

U.S. PATENT DOCUMENTS

| | | | | |
|---|---|---|---|---|
| 7,204,092 | B2 * | 4/2007 | Azcarate Castrellon | F25C 1/04 249/118 |
| 2006/0081662 | A1 | 4/2006 | Miura | |
| 2008/0041089 | A1 | 2/2008 | Choi et al. | |
| 2009/0032487 | A1 * | 2/2009 | Rekstad | B65D 47/2031 215/260 |
| 2011/0114220 | A1 | 5/2011 | Gill | |

FOREIGN PATENT DOCUMENTS

| | | | | | |
|---|---|---|---|---|---|
| JP | 09126649 | A | * | 5/1997 | |
| JP | H09-126649 | A | | 5/1997 | |
| JP | 10-220944 | | | 8/1998 | |
| JP | 10220944 | A | * | 8/1998 | |
| JP | H10-220944 | A | | 8/1998 | |
| JP | 2005-337601 | A | | 12/2005 | |
| KR | 20-2003-0001016 | | | 1/2003 | |
| KR | 20-2003-0001016 | | | 4/2003 | |
| KR | 10-2009-0016597 | A | | 2/2009 | |
| WO | WO 97/05436 | A1 | | 2/1997 | |
| WO | WO 2007/066958 | A1 | | 6/2007 | |
| WO | WO 2007/094554 | A1 | | 8/2007 | |
| WO | WO 2007091875 | A1 | * | 8/2007 | F25C 1/24 |

OTHER PUBLICATIONS

Chinese Office Action issued in Application No. 201310183528.2 dated Feb. 3, 2015.
Korean Office Action issued in Application No. 10-2012-0052368 dated Jul. 30, 2013.
European Office Action dated Jul. 19, 2016 issued in Application No. 13167895.5.

* cited by examiner

ICE MAKER FOR REFRIGERATOR

CROSS-REFERENCE TO RELATED APPLICATION(S)

This application claims priority under 35 U.S.C. §119 to Korean Application No. 10-2012-0052368 filed on May 17, 2012, whose entire disclosure is hereby incorporated by reference.

BACKGROUND

1. Field

This relates to an ice maker for a refrigerator, and, in particular, to an ice maker that accurately supplies a predetermined amount of water to an ice tray.

2. Background

A refrigerator may include a freezing chamber and a cold-storage chamber, and an ice maker for generating ice installed in the in the freezing chamber.

Such an ice maker may include an ice tray for receiving water to generate ice, with a plurality of grooves formed in the ice tray for freezing the water into separate ice pieces. To release the frozen ice pieces from the ice tray, the ice tray may be twisted, and then the ice tray may be rotated by rotating a handle that protrudes from an end of the ice tray, to drop the ice pieces into an ice box installed below the ice tray.

BRIEF DESCRIPTION OF THE DRAWINGS

The embodiments will be described in detail with reference to the following drawings in which like reference numerals refer to like elements wherein.

DETAILED DESCRIPTION

In supplying water to an ice tray of an ice maker, providing an excessive amount of water to the ice tray may cause water to overflow into the inside of an ice storage container, causing ice pieces stored in the ice storage container to be frozen together. When less than a predetermined amount of water is filled in the ice tray, a total amount of ice produced decreases, thus degrading efficiency of the ice maker.

Figure 1:
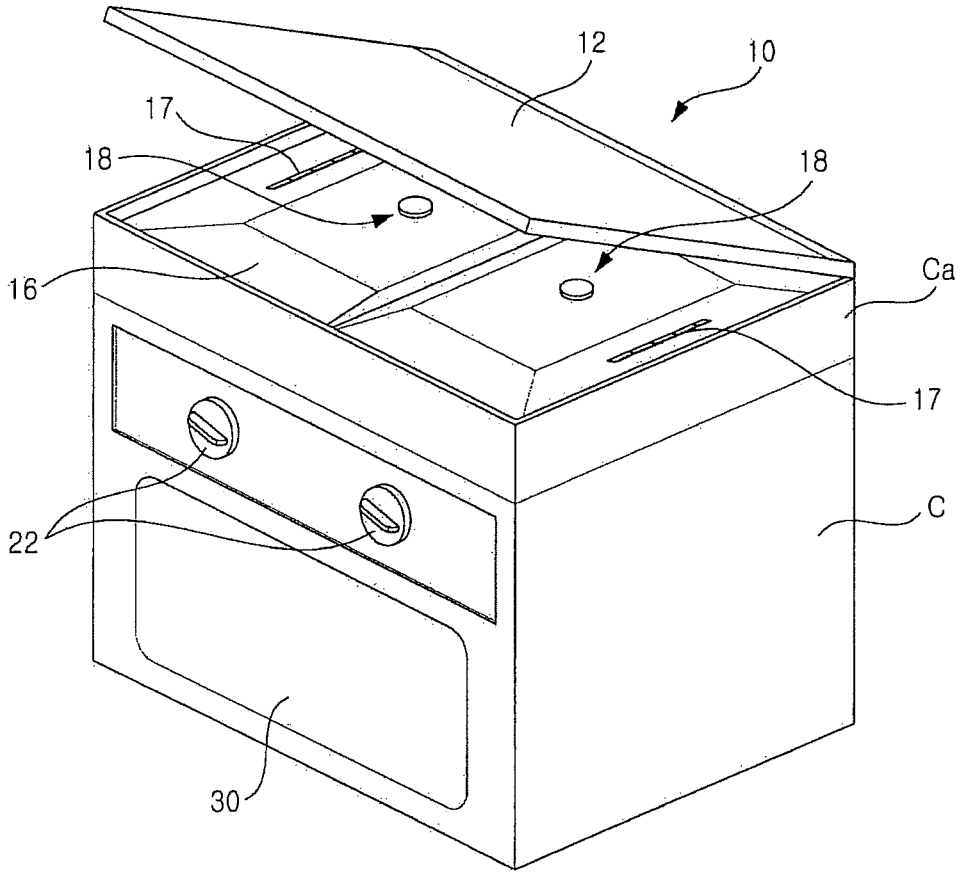
FIG. 1 is a perspective view of an exemplary ice maker for a refrigerator.
Figure 2:
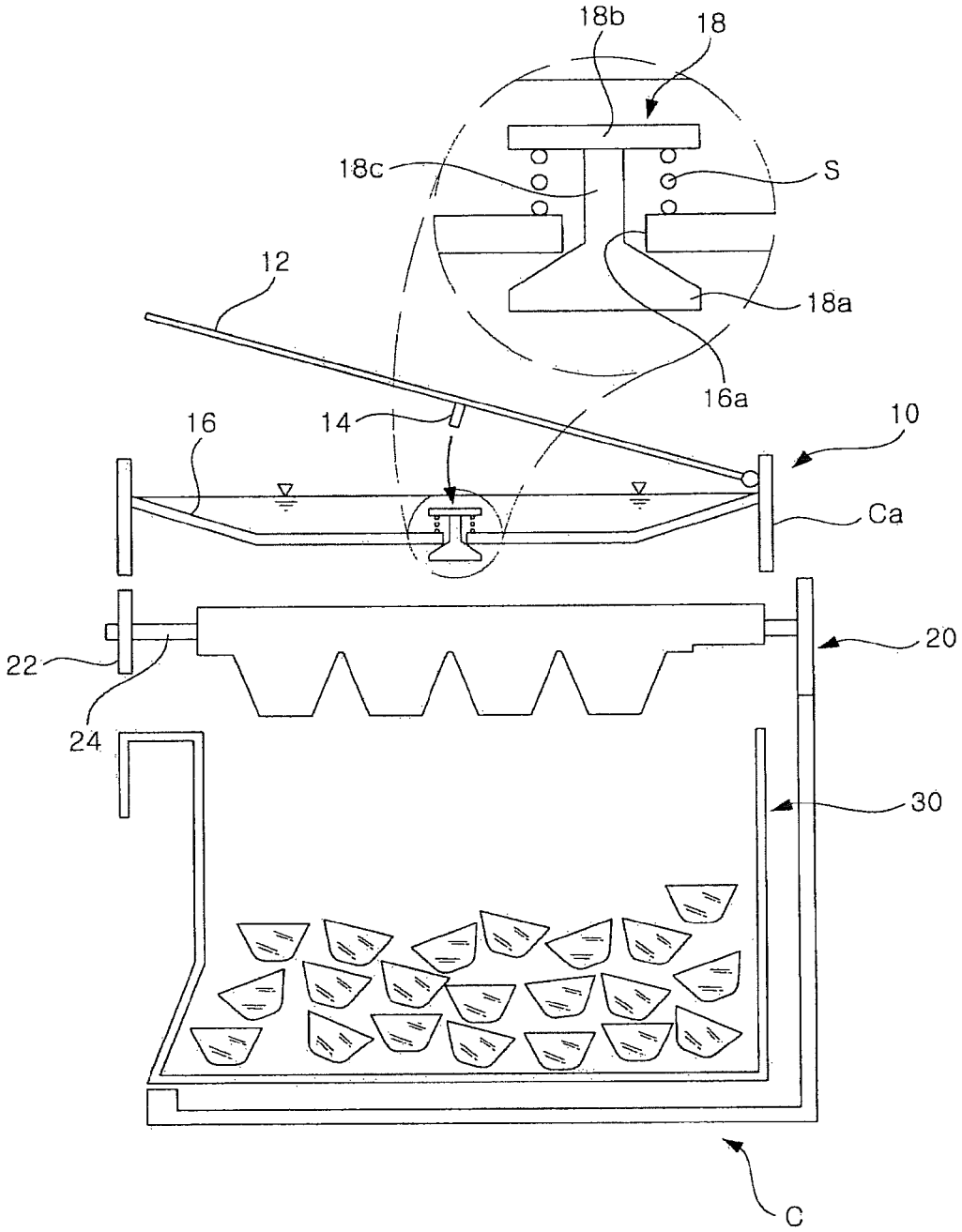
FIG. 2 is a cross-sectional view of the exemplary ice maker shown in FIG. 1.

As shown in FIGS. 1 and 2, an ice maker may include a feeding apparatus 10 for supplying water to an ice tray 20, and a storage container 30 for storing ice pieces frozen within the ice tray 20. The ice tray 20 and the storage container 30 may be, for example, detachably installed within one case C, and the ice tray 20 may be rotated by a handle 22 that protrudes outward from an end of the ice tray 20. The handle 22 may be connected to a central portion of the ice tray 20 by a rotation shaft 24 that rotatably supports the ice tray 20 within the case C.

The user may turn the handle 22 to rotate the ice tray 20 by a predetermined angle, an upper surface thereof may face downward, while one end of the ice tray 20 remains fixed to a corresponding structure of the inside of the case C and does not rotate, twisting the ice tray 20 and separating ice pieces from the ice tray 20 for storage in the storage container 30. When the handle 22 is returned to its original position, the ice tray 20 is returned to its original position, for example, a position in which the upper surface of the ice tray 20 faces upward, by operation of a spring installed in the rotation shaft 24.

The feeding apparatus 10 may be housed in a case Ca coupled to an upper portion of the case C and covered by a cover 12 to open and close a water container 16. The water container 16 may be formed at the inside of the feeding apparatus 10 and may be sized to hold an amount of water appropriate to fill the ice tray 20. The water container 16 may have an opened upper part and a concave shape that extends downward, and a display 17 may display an amount of water in the water container 16. Accordingly, when water is filled up to the display 17, an amount of water received therein corresponds to the amount of water required to fill the ice tray 20 one time.

A valve 18 may control flow through a supply hole 16*a* at a lower end portion of the water container 16. The valve 18 may receive an elastic force from a spring S in a direction that causes the supply hole 16*a* to be blocked. The valve 18 may include a switch valve portion 18*a* for opening or closing the supply hole 16*a*, and a support portion 18*c* extending from the switch valve portion 18*a* to a flange portion 18*b* extending radially outward from an upper end of the support portion 18*c*. The spring S may push up on the flange portion 18*b* so that the supply hole 16*a* is always blocked by the switch valve portion 18*a* in absence of an external force.

A pressing protrusion 14 may be formed on a bottom surface of the cover 12. To supply water to the water container 16, the cover 12 is opened, moving the pressing protrusion 14 away from the valve 18 so that the valve 18 blocks the water supply hole 16*a*. Water is poured into the container 16 and the cover 12 is closed, causing the pressing protrusion 14 to press the valve 18 and open the supply hole 16*a*.

That is, because the spring S is compressed, the switch valve portion 18*a* is separated from the supply hole 16*a*, and thus water may flow downward through a gap between the support portion 18*c* and the supply hole 16*a*, whereby a predetermined amount of water may be accurately supplied to the ice tray 20.

However, this flat cartridge-shaped water container may still allow water poured into the water container to splash or overflow to the outside. Further, if some water were to remain in the water container 16 and be frozen, the valve 18 may remain open even when the cover 12 is opened to release the protrusion 14 from the valve 18, and water may leak downward as the frozen water near the valve 18 melts. Additionally, when twisting the ice tray 20 as described above, there may be some interference between the switch valve portion 18*a* and the ice tray 20, possibly damaging the switch valve portion 18*a*.

An ice maker for a refrigerator according to an exemplary embodiment may be installed as an ice maker assembly at an inside shelf of a freezing chamber, or may be mounted in an inside door of a freezing chamber, and particularly, in a two door type refrigerator, the ice maker for a refrigerator may be mounted in an inside door of the left side or the right side of the freezing chamber.

Figure 3:
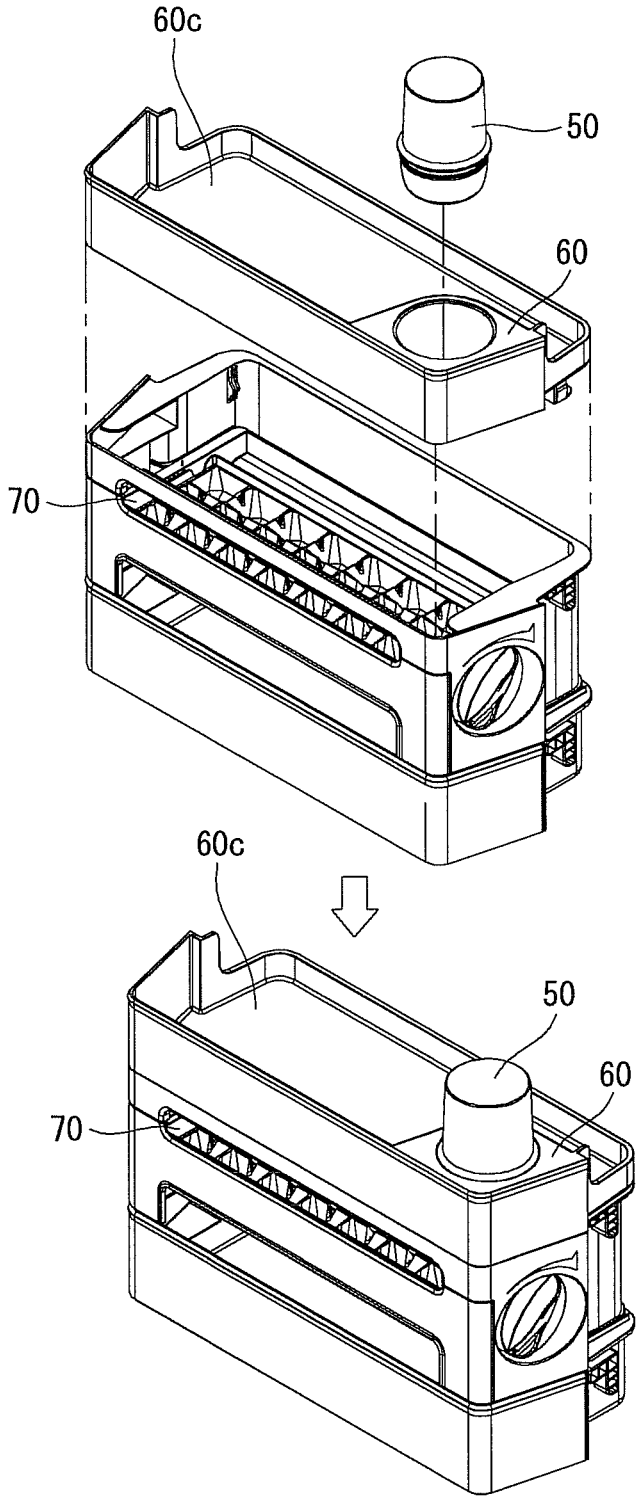
FIG. 3 is a perspective view of an ice maker for a refrigerator according to an exemplary embodiment as broadly described herein.

As shown in FIG. 3, an ice maker for a refrigerator as embodied and broadly described herein may include a water container 50 inverted and received within a housing 60 provided on a cover case 60*c* that covers an entire upper part of an ice tray 70. A cylindrical water bottle, or water bottles having various shapes, such as, for example, a rectangular shape, or other shape as appropriate, may be used as the water container 50.

Figure 4:
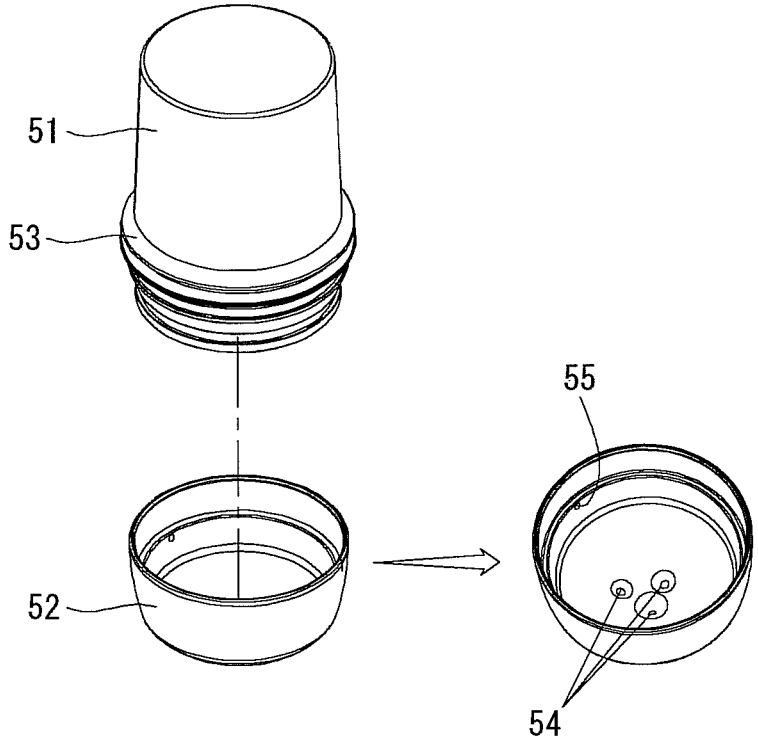
FIG. 4 is a perspective view of a water container according to an exemplary embodiment as broadly described herein.

As shown in FIG. 4, the water container 50 may include a body 51 for receiving water and a lid 52 having a plurality of (e.g., 3) holes 54 for naturally discharging water by gravity when the container 50 is inverted. The lid 52 may be easily coupled to and detached from the body 51. A latch jaw 53 may be formed at an outer circumferential surface of the body 51, the latch jaw 53 forming a ring-shaped protrusion for securely housing the water container 50 in the housing 60. In order to completely discharge water from the body 51 through the plurality of holes 54, an inside surface of the lid 52 where the holes 54 are formed may be curved to cause the water to naturally flow down toward the holes 54. For example, as shown in FIG. 4, three penetration holes 54 for naturally discharging water by gravity and an air inlet 55 for promoting discharge of water may be formed in the lid 52, and a bottom surface of the inside of the lid 52 may be formed as a concave curved surface instead of a plane.

Figure 5:
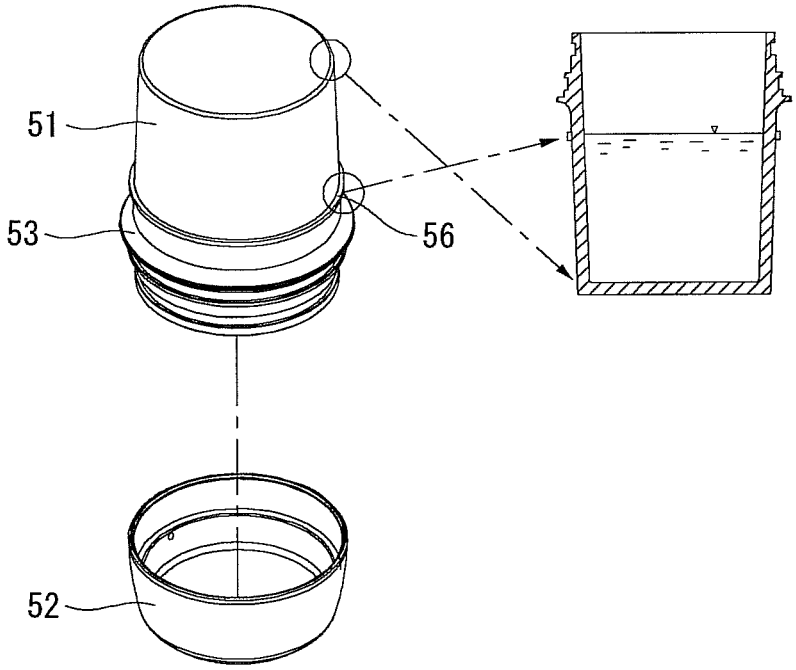
FIG. 5 is a perspective view of a water container according to another exemplary embodiment as broadly described herein.

As shown in FIG. 5, a display 56 for accurately indicating a predetermined amount of water in the body 51 may be formed as a ring-shaped protrusion or may be displayed in a mark shape on the body. Alternatively, if such a display 56 is not separately shaped or displayed, if water is filled to the latch jaw 53 forming a ring-shaped protrusion, an inside amount of the body 51 may be set so that an appropriate amount of water for the ice tray 70 corresponds to the position of the latch jaw 53.

Figure 6:
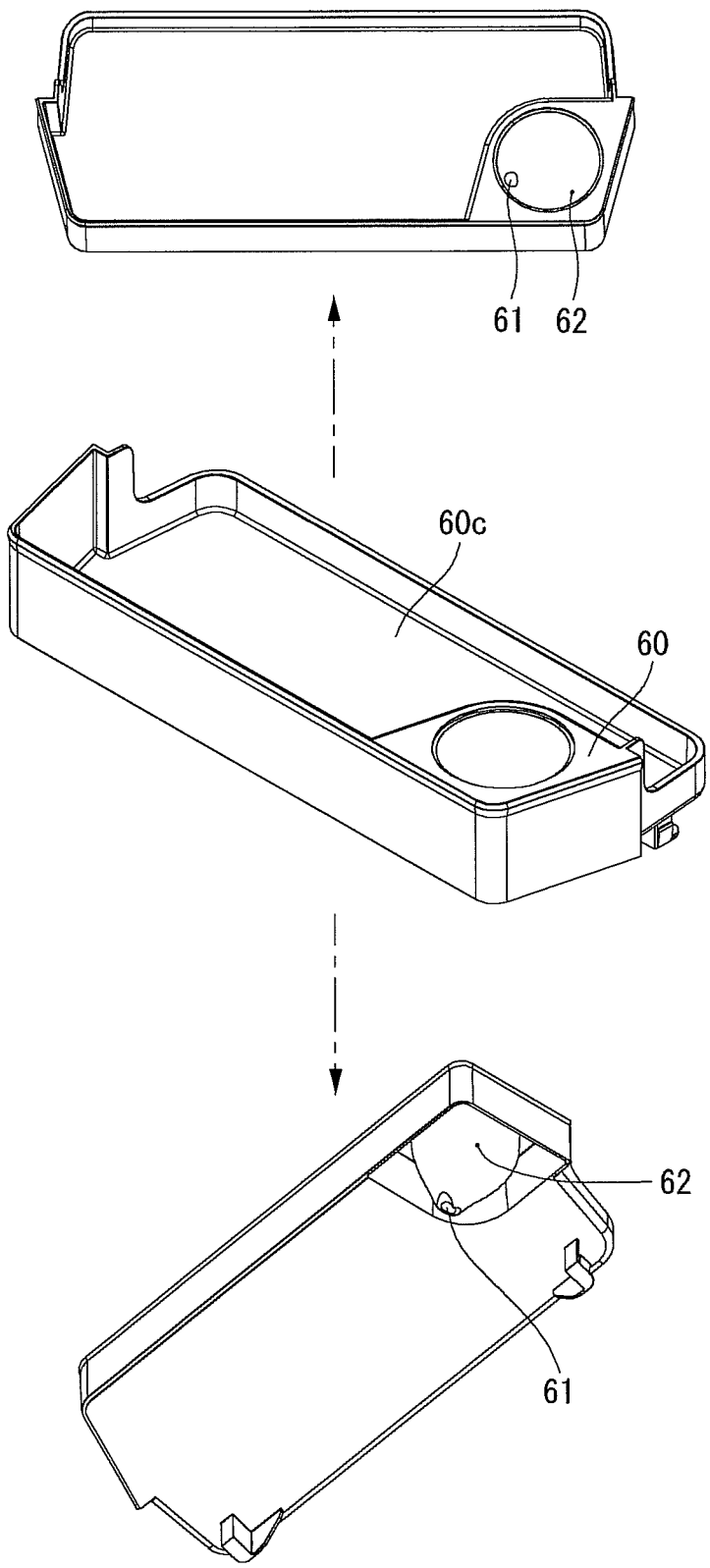
FIG. 6 is a perspective view of a housing according to an exemplary embodiment as broadly described herein.

As shown in FIG. 6, the housing 60 may be provided at one side surface of a flat cover case 60*c* that covers an entire upper part of the ice tray 70, and may include a funnel-shaped holder having a water outlet 61 and a channel, which may define a water moving path for collecting water that vertically flows through the plurality of holes 54 formed in lid 52 of the water container 50 and supplying the water into a groove of the ice tray 70.

Figure 7:
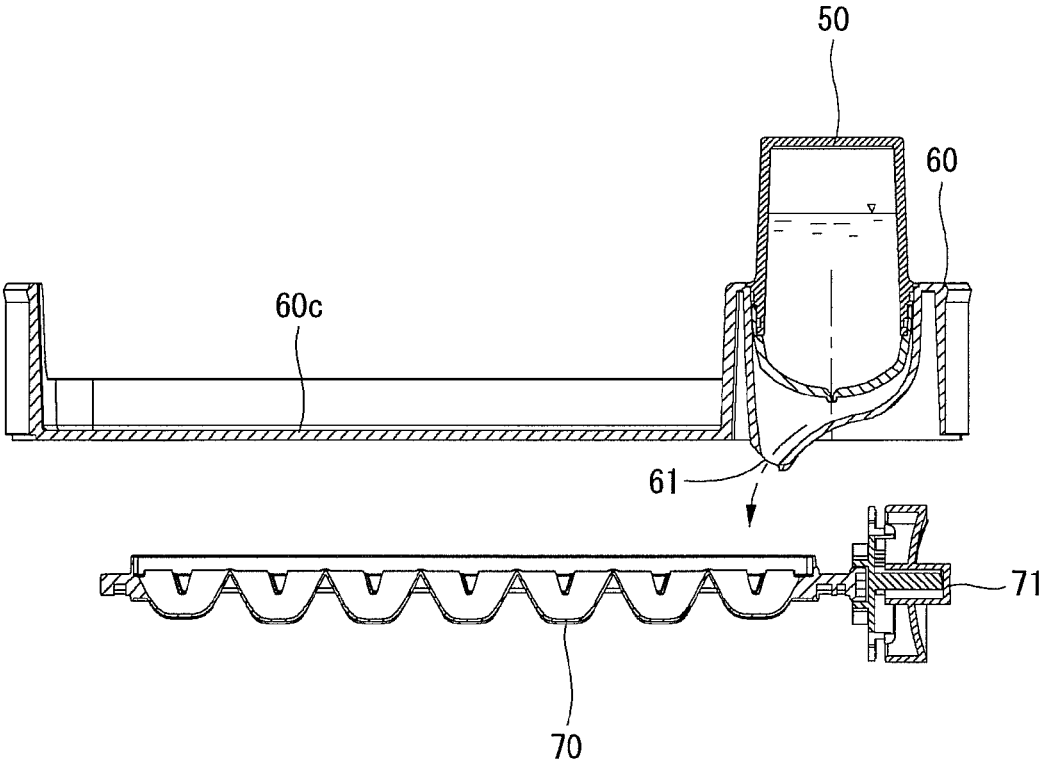
FIG. 7 is a partial cross-sectional view of an ice maker for a refrigerator according to an exemplary embodiment as broadly described herein.
Figure 8:
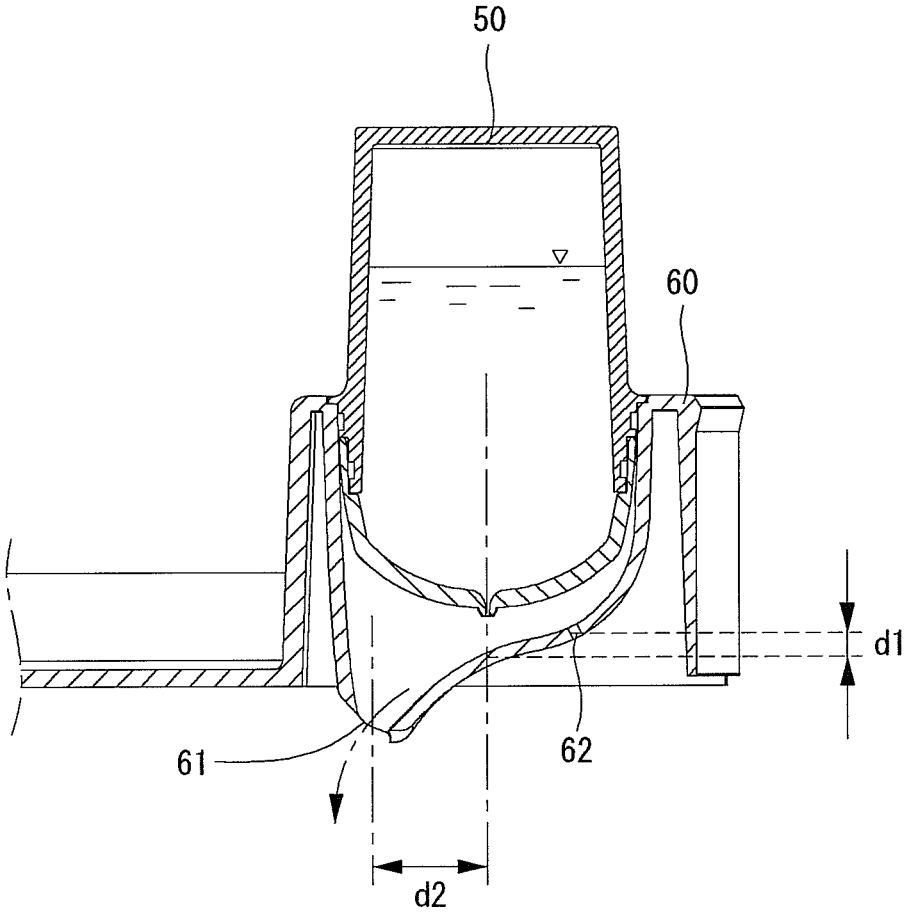
FIG. 8 is a partial cross-sectional view of a housing according to an exemplary embodiment as broadly described herein.

As shown in FIG. 7, the housing 60 may be installed above a handle 71 for twisting the ice tray 70 as described above. As shown in FIG. 8, the housing 60 may include an air inlet 62 for promoting drainage formed at a higher position in a vertical direction than the water flow path defined by the funnel-shaped channel and the water outlet 61. The air inlet 62 may be positioned a vertical distance d1 above a point at which water flowing out of the container 40 impacts the funnel-shaped channel of the housing 60.

When the water container 50 is inverted and received in the housing 60, clearance space is formed so that the plurality of holes 54 formed in the lid 52 do not contact a bottom surface of the inside of the housing 60, and a central vertical axis of the water outlet 61 is separated by a predetermined gap (d2 of FIG. 8) from that of the water container 50. That is, a central vertical axis of the water outlet 61 is offset from a central vertical axis of the water container 50 by a distance d2.

Accordingly, water vertically flowing from the water container 50 may be collected and injected into the ice tray 70, and the housing 60 very closely contacts one side surface of the cover case 60*c*, and thus the remaining area of the cover case 60*c* may accommodate other components.

Further, because the air inlet 62 formed in the housing 60 is formed at a higher vertical position than the water impact point of the funnel-shaped channel and the water outlet 61, water may be prevented from leaking to the outside through the air inlet 62.

Figure 9:
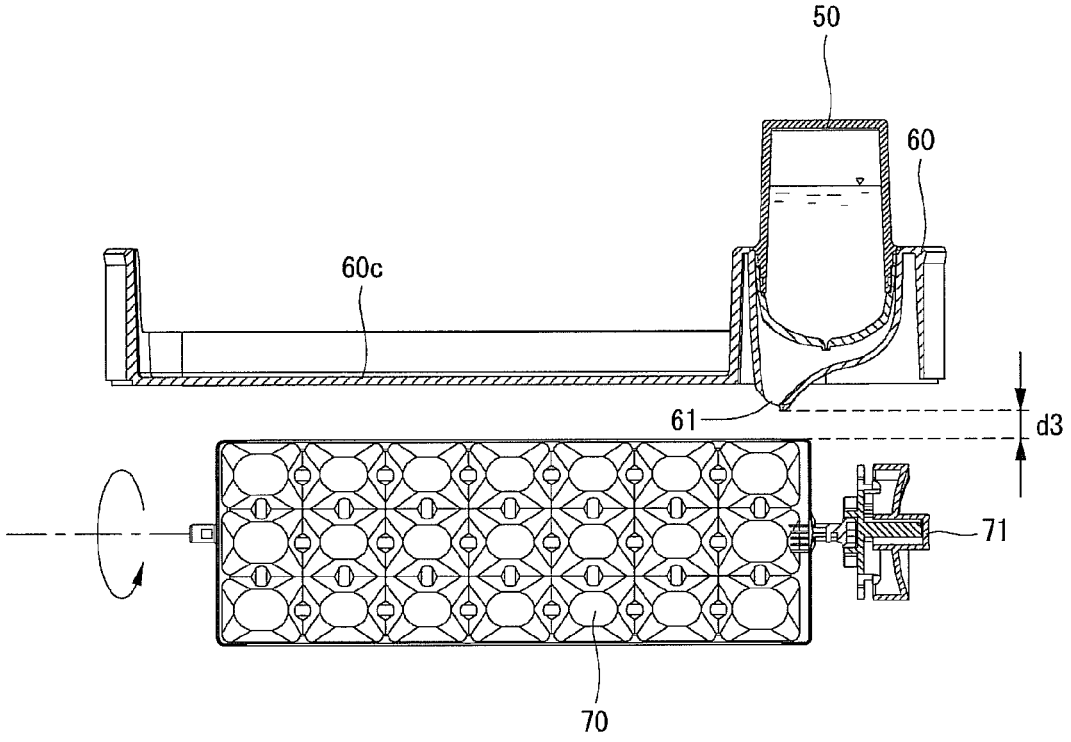
FIG. 9 is a cross-sectional view of an ice tray rotated by 90° according to an exemplary embodiment as broadly described herein.

As shown in FIG. 9, as the handle 71 exposed at an end of the ice tray 70 is rotated, even if the ice tray 70 is rotated by 90°, the water outlet 61 is installed at a position having a predetermined separation gap with a corresponding end of the rotated ice tray 70 (d3 of FIG. 9) so that there is no interference between the water outlet 61 and the ice tray 70.

In certain embodiments, the lid 52 may include one hole 54. In alternative embodiments, the lid 52 may include a plurality of holes 54. A discharge area provided by the one or more holes 54 formed in the lid 52 may be matched to the discharge area provided by the water outlet 61 to provide the desired flow rate of water into the ice tray 70 to prevent splashing and/or misdirection of water. In certain embodiments, the discharge area provided by the one or more holes 54 may be set to be a predetermined percentage of the discharge area of the water outlet 61 based on the capacity of the container 50 and the like to provide the desired flow rate. Similarly, the offset distance d2 between the central axis of the water container 50 and the water outlet 61 may be set to provide the desired flow rate of water through the channel and into the ice tray 70. In certain embodiments, the offset distance d2 may be set to be a predetermined percentage of the diameter of the water container 50 to provide the desired flow rate. Numerous combinations of discharge areas of the one or more holes 54 and the water outlet 61, and offset distances d2, may be appropriate, based on a size of the ice maker and specific installation in a refrigerator.

Figure 10:
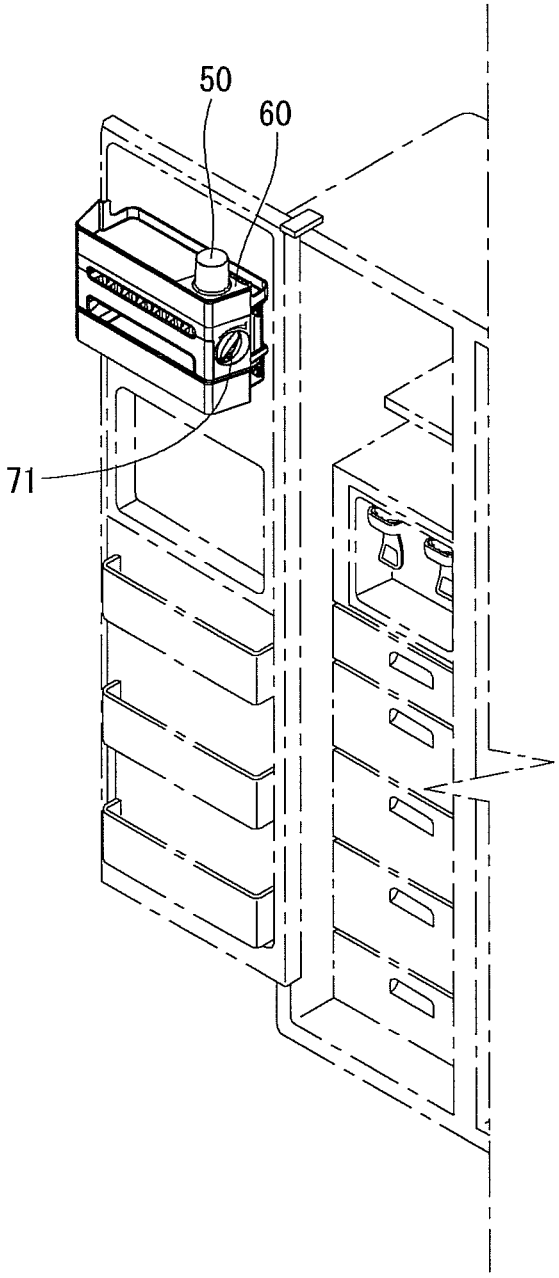
FIG. 10 is a perspective view of an ice maker installed at an inside of a left door of a refrigerator according to an exemplary embodiment as broadly described herein.
Figure 11:
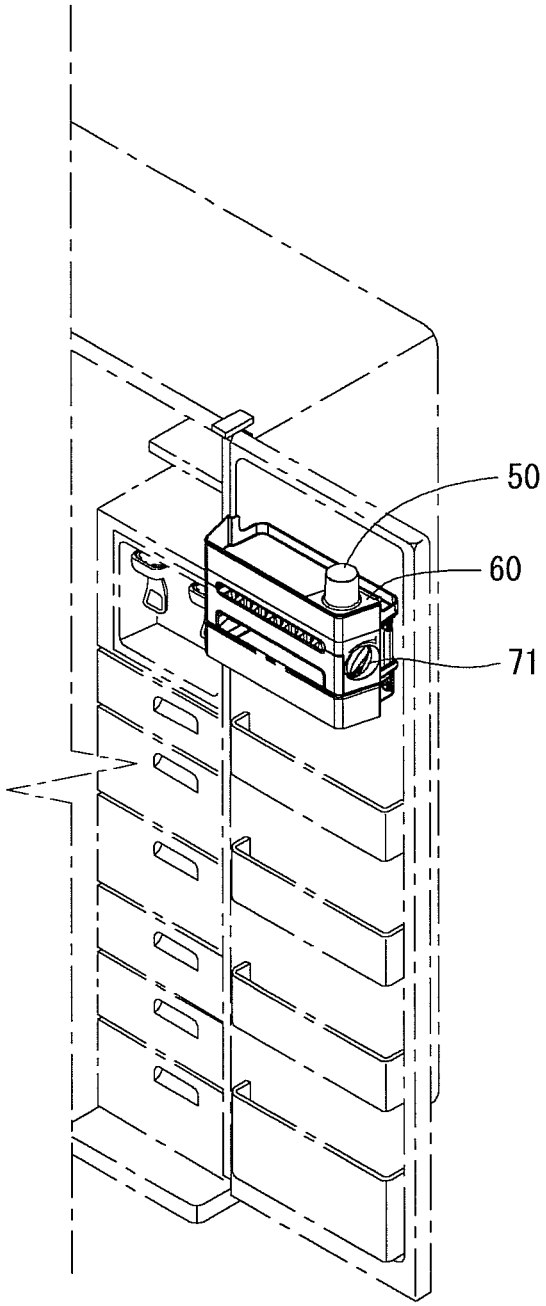
FIG. 11 is a perspective view of an ice maker installed at an inside of a right door according to an exemplary embodiment as broadly described herein.

When the ice maker for the refrigerator is installed on a door at the inside of the freezing chamber of a refrigerator, the housing 60 and the handle 71 of the ice tray 70 may be positioned at, for example, the right side of the ice maker when the door is open. For example, as shown in FIG. 10, when a freezing chamber of a side by side, two door type refrigerator is located at the left side, if a left door corresponding to the freezing chamber is opened, the ice maker may be installed so that the housing 60 and the handle 71 of the ice tray 70 are positioned at the right side to facilitate removal and replacement of the water container and rotation of the handle 71. As shown in FIG. 11, when a freezing chamber of a side by side, two door type refrigerator is located at the right side, if a right door corresponding to the freezing chamber is opened, the ice maker may be installed so that the housing 60 and the handle 71 of the ice tray 70 are positioned at the right side.

Alternatively, the housing 60 and the handle 71 of the ice tray 70 may be provided on the left side in either of the exemplary installations shown in FIGS. 10 and 11.

After the water container 50 is removed from the housing 60 and the lid 52 is separated from the body 51, water may be filled in the body 51 while viewing the display 56 formed as a ring-shaped protrusion or displayed as a mark at an outer circumferential surface of the body 51 to fill a predetermined amount of water in the body 51. When the display 56 is not provided, a predetermined amount of water may be filled in the body 51 based on a position the latch jaw 53 formed at an outer circumferential surface of the body 51. Thereafter, the lid 52 of the water container 50 may be re-attached, the water container 50 may be inverted, and then housed within the housing 60, and the latch jaw 53 formed at an outer circumferential surface of the body may ensure that the water container 50 and the housing 60 are securely attached and the container 50 is housed at an appropriate depth. Water received in the water container 50 may be naturally discharged downward through the plurality of holes 54 formed in the lid 52, and air may be injected through the air inlet 55 formed in the lid to promote smooth drainage. Accordingly, because water may be naturally discharged from the water container 50 and supplied into a groove of the ice tray 70 through the water outlet 61 of the housing 60, a predetermined amount of water may be accurately supplied without using a complicated valve structure.

Further, as water is poured into the water container, splashing or overflowing to the outside may be prevented, and even if some water remaining within the cylindrical water container is frozen, when water is again poured into the water container, water may be prevented from leaking.

Further, because a valve and other related structure does not protrude downward for water supply, collision between this type of structure and the ice maker may be prevented as the ice tray is rotated.

An ice maker for a refrigerator is provided that can accurately and simply supply a predetermined amount of water to an ice tray using a water container having a simple structure such as a cylindrical water container including a body for receiving water and a lid having a hole for discharging water in order to supply water into the ice tray.

In accordance with an aspect of the present invention, there is provided an ice maker for a refrigerator, as embodied and broadly described herein, may include an ice tray for putting water for generating ice; a water container including a body for putting water and a lid having a hole for discharging water in order to supply a predetermined amount of water into the ice tray; and a housing for housing the water container in a case of the ice maker.

In one embodiment, the water container may be a cylindrical water bottle and is invertedly housed in the housing. In the lid, an air inlet and a plurality of holes for naturally discharging water may be formed. In the body, a display unit for accurately putting a predetermined amount of water may be formed in a protrusion shape or be displayed in a mark shape.

In one embodiment, a bottom surface of the inside of the lid may be formed in a curved surface to completely discharge water through the hole. At an outer circumferential surface of the body, a latch jaw for fastening to the housing may be formed.

In one embodiment, the housing may close contact with one side surface of a cover case that covers an entire upper part of the ice tray. The housing may be installed in an upper portion of a handle for twisting the ice tray by rotating in a length direction.

In one embodiment, the housing may be installed at the right side of a user, when a door of a freezing chamber in which the ice maker is installed is opened. The housing may be a funnel-shaped holder having a water outlet and a channel for collecting water vertically flowing through the hole formed in the lid of the water container and for supplying the water to the ice tray.

In one embodiment, in the housing, an air inlet for promoting discharge of water may be formed at a higher position in a vertical direction than that of the channel and the water outlet. A central vertical axis of the water outlet may be separated by a predetermined gap from that of the water container.

In one embodiment, clearance space may be formed at a bottom surface of the inside of the housing so that the hole formed in the lid of the water container does not contact with the housing, when the water container is housed in the housing. The water outlet may be separated by a predetermined gap in a vertical direction of the ice tray to prevent from colliding with the ice tray, when the ice tray is twisted by 90° in a length direction.

An ice maker for a refrigerator as embodied and broadly described herein uses a water container having a simple structure such as a cylindrical water bottle including a body for receiving water and a lid having holes for discharging water. Thus, a complicated structure such as a valve is not necessary, and water may be prevented from splashing or overflowing to the outside when filling the water container.

Further, if residual water in a water container such as a cylindrical water bottle is frozen, an ice maker for a refrigerator as embodied and broadly described herein may prevent water from leaking when water is supplied to the water container.

Additionally, because an ice maker for a refrigerator as embodied and broadly described herein does not include a valve protruded downward for supplying water, collision between the ice maker and such a valve may be prevented as the ice tray rotates.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An ice maker for a refrigerator, comprising:

an ice tray provided in a freezing chamber of the refrigerator and configured to receive water to be frozen into ice;

a water container that supplies a predetermined amount of water to the ice tray, the water container including:

a body; and a lid removably coupled to the body, the lid having at least one hole formed therein through which water is discharged from the water container and a first air inlet formed in a side of the lid to promote discharge of water; and a housing provided in a case of the ice maker and covering an entire upper part of the ice tray, the housing including a funnel-shaped holder configured to receive the water container and a flat surface configured to accommodate other components, wherein the water container is removably coupled to the holder of the housing and positioned apart from the ice tray, wherein the water container is configured to be installed in the freezing chamber, wherein the water container is inverted for coupling in the housing, wherein the at least one hole of the lid of the water container is always open regardless of an existence of the water in the water container in a state that the water container is inverted, and wherein the holder includes a channel collecting water discharged through the at least one hole formed in the lid of the water container, a water outlet that guides the water from the channel to the ice tray, and a second air inlet formed at a higher position in a vertical direction than a position at which the water discharged through the at least one hole formed in the lid of the water container impacts the channel.

2. The ice maker of claim 1, wherein the ice tray is oriented horizontally as the water container is inverted for coupling in the housing, and wherein the ice tray remains oriented horizontally as water received in the water container is discharged into the ice tray through the at least one hole formed in the lid of the water container.

3. The ice maker of claim 1, wherein the body of the water container is cylindrical and has an open end to which the lid is removably coupled, wherein the water container is filled in a first position in which the open end thereof faces upward with the lid removed, and is positioned in the housing in a second position in which the open end having the lid coupled thereto faces downward to discharge water to the ice tray.

4. The ice maker of claim 3, further including an indicator provided on the body at a third position corresponding to the predetermined amount of water, wherein the indicator includes a protrusion or a mark provided on an interior or an exterior of the body.

5. The ice maker of claim 1, further including a latch jaw formed at an outer circumferential surface of the body of the water container for fastening the water container to the housing.

6. The ice maker of claim 1, further including a handle provided at one end of the ice tray, wherein the ice tray rotates in a length direction in response to rotation of the handle, and wherein the housing is positioned above the handle.

7. The ice maker of claim 1, wherein the case is configured to be installed on an interior side of a door of the freezing chamber of the refrigerator.

8. The ice maker of claim 1, wherein the water outlet is separated from the ice tray by a predetermined vertical gap to prevent interference between the water outlet and the ice tray as the ice tray is twisted in a length direction.

9. The ice maker of claim 1, wherein an interior surface of the lid in which the at least one hole is formed has a curved shape so as to completely discharge water received in the water container through the at least one hole in the state that the water container is inverted.

10. The ice maker of claim 1, wherein a space is formed between a lower interior surface of the holder and the lid coupled to the body and received in the holder such that the at least one hole formed in the lid does not contact the housing, when the water container is coupled in the holder.

11. The ice maker of claim 1, wherein an open end of the water outlet and a horizontal axis of the ice tray are not parallel.

12. The ice maker of claim 1, wherein the second air inlet and the water outlet are provided on opposing sides about the central vertical axis.

13. The ice maker of claim 1, wherein the water outlet is offset from a central vertical axis of the water container received in the housing such that the water discharged from the water container impinges on an interior surface of the holder and is directed through the channel into the water outlet.

14. An ice maker for a refrigerator, comprising:

an ice tray provided in a freezing chamber of the refrigerator;

a cover positioned across and spaced apart from an open top of the ice tray, the cover covering an entire upper part of the ice tray, and including a flat surface configured to accommodate other components and a funnel-shaped holder; and a water container removably coupled in the holder of the cover in an inverted position, the water container including:

a body; and a lid removably coupled to the body, the lid having at least one hole formed therein through which water is discharged from the water container in the inverted position and a first air inlet formed in a side of the lid to promote discharge of water, wherein the at least one hole of the lid of the water container is always open regardless of an existence of the water in the water container in a state that the water container is inverted, and wherein the holder includes a channel collecting water discharged through the at least one hole formed in the lid of the water container, an water outlet that guides the water from the channel to the ice tray, and a second air inlet formed at a higher position in a vertical direction than a position at which the water discharged through the at least one hole formed in the lid of the water container impacts the channel.

15. The ice maker of claim 14, wherein the ice tray is oriented horizontally as the water container is inverted for coupling in the cover, and wherein the ice tray remains oriented horizontally as water received in the water container is discharged into the ice tray through the at least one hole formed in the lid of the water container.

16. The ice maker of claim 14, wherein an interior surface of the lid in which the at least one hole is formed has a curved shape so as to completely discharge water received in the water container through the at least one hole in the state that the water container is inverted.

17. The ice maker of claim 14, wherein the second air inlet and the water outlet are provided on opposing sides about the central vertical axis.

18. The ice maker of claim 17, wherein an open end of the water outlet and a horizontal axis of the ice tray are not parallel.

19. The ice maker of claim 17, wherein a central vertical axis of the water outlet is offset from a central vertical axis of the water container received in the holder such that water discharged from the water container through the at least one in the lid impinges on an interior surface of the holder and is directed into the channel.

20. The ice maker of claim 14, wherein the water outlet is separated from the ice tray by a predetermined vertical gap to prevent interference between the water outlet and the ice tray as the ice tray is twisted in a length direction.

* * * * *